United States Patent [19]

Omura et al.

[11] Patent Number: 4,908,280

[45] Date of Patent: Mar. 13, 1990

[54] SCRATCH AND CORROSION RESISTANT, FORMABLE NICKEL PLATED STEEL SHEET, AND MANUFACTURING METHOD

[75] Inventors: Hitoshi Omura, Kudamatsu; Katsutada Yamada, Hikari; Hideo Omura, Hofu, all of Japan

[73] Assignee: Toyo Kohan Co., Ltd., Chiyoda, Japan

[21] Appl. No.: 377,485

[22] Filed: Jul. 10, 1989

[51] Int. Cl.[4] ..... B32B 15/04; C25D 5/14; C25D 5/50

[52] U.S. Cl. ..... 428/679; 204/37.1; 204/44.7; 427/383.9

[58] Field of Search ..... 428/679, 680, 935, 936; 204/40, 44.7, 37.1; 427/437, 438, 376.8, 383.9

[56] References Cited

U.S. PATENT DOCUMENTS

| | | | |
|---|---|---|---|
| 2,633,631 | 4/1953 | Horvitz | 428/679 |
| 2,643,221 | 6/1953 | Brenner et al. | 204/44.7 |
| 3,077,421 | 2/1963 | Budminkas | 428/679 |
| 3,183,067 | 5/1965 | Du Rose et al. | 204/40 |
| 3,594,288 | 7/1971 | Reinhert | 204/40 |
| 4,345,007 | 8/1982 | Fahy et al. | 204/40 |
| 4,411,961 | 10/1983 | Tremmel | 204/40 |
| 4,629,659 | 12/1986 | Kyono et al. | 204/44.7 |
| 4,758,479 | 7/1988 | Swathirajan et al. | 428/679 |

FOREIGN PATENT DOCUMENTS

| | | | |
|---|---|---|---|
| 56-29680 | 3/1981 | Japan | 204/37.1 |
| 59-140389 | 8/1984 | Japan | 204/37.1 |
| 59-159994 | 9/1984 | Japan | 204/44.7 |
| 60-5894 | 1/1985 | Japan | 427/383.9 |
| 624252 | 5/1949 | United Kingdom | 204/37.1 |

OTHER PUBLICATIONS

A. Brenner et al., Electrodeposition of Alloys of Phosphorus with Nickel or Cobalt, Journal of Research–National Bureau of Standards, Paper No. KP2061, vol. 44, Jan. 1950, pp. 109–119.

*Primary Examiner*—John J. Zimmerman
*Attorney, Agent, or Firm*—Felfe & Lynch

[57] ABSTRACT

An anti-scratch nickel plated steel sheet and strip is provided which comprises, applying a nickel plating to both sides of the sheet or strip, subsequently plating a nickel phosphorus alloy on at least one or the other side of said plated layer, then subjecting said plated article to a heat treatment under conditions sufficient to form a nickel ferrous alloy layer and to obtain a hardening effect of said nickel phosphorus alloy plated layer.

9 Claims, No Drawings

SCRATCH AND CORROSION RESISTANT, FORMABLE NICKEL PLATED STEEL SHEET, AND MANUFACTURING METHOD

SUMMARY

The invention relates to a process for producing a nickel plated steel sheet and strip having an anti-scratch property as well as corrosion resistance and formability.

DESCRIPTION OF THE INVENTION

An electrolytic nickel plated steel sheet and strip has been used to substitute for a barrel plating, which barrel plating has the disadvantage of poor productivity and poor uniformity of coating thickness. However, when a nickel plated steel sheet and strip is merely plated, the plated layer has a tendency to peel or flake due to its poor coating adhesion. In order to solve the problem, the coating adhesion has been secured by carrying out a heat treatment after a nickel plating by which a nickel ferrous alloy layer is formed between a base steel and a plated layer (For example, Japanese Patent Laid-Open Application No. 61-235594). Moreover, a heat treatment has an effect on corrosion resistance, particularly in highly stretched or drawn formed parts. The reason is as follows; a surface of a merely as-plated steel is remarkably hard and rather brittle, so it is easy to crack during a process of forming. On the other hand, when it is heat treated after a nickel plating, the plated surface layer is softened to such an extent as to become ductile due to the stress release stored in the electrodeposit and the recrystallization of plated nickel itself. That improved ductility makes possible a plated steel able to endure deformation in a forming process. A nickel ferrous alloy layer itself also functions to reduce a potential gradient when a local cell is formed between and a base steel and a nickel layer to a base steel as stated above.

It is considered that these contribute to improving corrosion resistance. Adversely, as a result of softening, a plated surface is inevitably susceptible to being damaged during transport or during a process of forming. Not only scratch resistance but also corrosion resistance decreases conversely on that damaged part. For example, when a base steel is exposed to a deeply scratched surface of a dry cell case, it would introduce the danger of perforated corrosion and leakage of the electrolyte, thereby causing peripheral electronic circuit failure.

The process according to the invention comprises, first subjecting a steel sheet and strip to a nickel plating with a coating weight of 5 to 45 g/m$^2$ on each side of said sheet or strip and subsequently to a nickel phosphorus alloy plating with a coating weight of 1 to 18 g/m$^2$ by weight of nickel and a phosphorus content of 3 to 15% by weight on at least one side, and then applying a heat treatment at a temperature of 450° to 800° C. for 0.2 to 900 minutes. The present invention is explained in detail below.

Base Steel

A cold rolled carbon steel, in particular, a low-carbon aluminum killed continuous cast steel is preferably employed for a base steel of the present invention. In addition, an extra-low-carbon steel with a carbon content less than 0.003% by weight or a further addition of titanium or niobium for non-aging element can be used when required to improve the mechanical properties of the steel by means of a continuous annealing process instead of a batch annealing. Moreover, a chromium contained steel with a chromium content of 3 to 7% by weight or a stainless steel also can be employed in the invention.

Nickel plating

Any baths that have been developed for nickel plating e.g. Watts bath, sulfamate bath, boron fluoride bath, chloride bath and other baths may be used for the present invention. As regards the pretreatment of nickel plating, the details are well known; that is, a steel is degreased chemically or electrolytically by alkali or organic solvent, then pickled chemically or electrolytically by sulfuric, hydrochloric, or nitric acid.

In the case of nickel plating on a stainless steel or a chromium contained steel, the well-known Wood's nickel strike or sulfamate nickel strike is carried out to insure an adequate coating adhesion in advance of a nickel plating.

Nickel plating by well-known Watts bath is usually practiced at a current density of about 3 to 80 A/dm$^2$ in a bath at a temperature of 40° to 60° C. and a preferred pH range of 3.5 to 5.5. In this case, it is not desirable to add a brightening agent containing a sulfur element, for example, naphthalenesulfonate because sulfur makes a plated layer brittle when heated. Brightening agents containing no sulfur constituent such as butyne diol, coumarin and ethylene cyanic hydride are preferred in the present invention.

As regards the coating weight of the nickel plating, it should be in the range of 5 to 45 g/m$^2$ on each side of a steel sheet or strip, preferably in a range from 18 to 36 g/m$^2$. A nickel plated layer having a coating thickness less than 5 g/m$^2$ does not provide the desired improvement in corrosion resistance. On the other hand, the maximum coating weight of 45 g/m$^2$ in the present invention is determined by the economics by considering the effect on corrosion resistance as against the cost.

Nickel Phosphorus Alloy Plating

A nickel phosphorus alloy plating can be carried out directly after rinsing a nickel plated steel sheet or strip, though pretreatment of degreasing, rinsing and pickling is needed if it is dried and kept for quite a long time. Either an electroless or an electrolytic plating method may be applied in the present invention. An electroless plating method has been widely adopted, for example, for the manufacture of magnetic discs, whereas an electrolytic plating has an advantages of being capable of continuously plating in strip form at a relatively high speed. Concerning electroless plating, a bath containing hypophosphite as a reducing agent has usually been employed. As a typical example, a bath composed of nickel sulfate of 20 to 50 g/l, nickel chloride of 15 to 40 g/l, sodium hypophosphite of 20 to 50 g/l, and an organic addition of sodium acetate and succinic acid, citric acid, malic acid or their salts. The plating is carried out at a relatively high temperature of 80° to 95° C. and in an approximate pH range of 4.3 to 5.5.

A coating weight of nickel phosphorus plating should be in the range of 1 to 18 g/m$^2$ by nickel on at least one or the other side of the strip or sheet, and preferably in a range from 3 to 10 g/m$^2$ in order to assure an optimum improvement of the anti-scratch property. A phosphorus content in the plating should be in the 3 to 15% by weight range, and preferably in a range from 5 to 12% by weight. A layer having a coating thickness of less than 1 g/m$^2$ does not provide the desired improvement in anti-scratch property. On the other hand, a layer with a coating weight exceeding 18 g/m$^2$ tends to impair formability due to excess hardening by the heat treatment. Also, a phophorus content of less than 3% is not sufficient to effect a precipitation hardening by heat treatment, and plating with a content exceeding 15% cannot be processed in a stable manner.

An electroless nickel phosphorus plating requires a longer time to obtain a desired coating thickness than an electrolytic plating method. An electroless plating method is thus difficult to continuously process, so a cut sheet is immersed in said bath for approximate 40 seconds to 25 minutes according to the coating thickness required. An electrolytic plating method has the advantage of being capable of plating in a shorter time compared with a electroless plating method. As regards the plating bath, the bath is composed of nickel sulfate, nickel chloride or nickel sulfamate, to which hypophosphorus acid, phosphorous acid, phosphoric acid, hypophosphite, phosphite, or phosphate are added. A typical bath is basically composed of nickel sulfate and nickel chloride; for example, nickel sulfate of 100 to 350 g/l and nickel chloride of 10 to 50 g/l, to which phosphorous acid of 5 to 40 g/l or further phosphoric acid of 5 to 100 g/l is added. A plating is cathodically treated at a current density of 3 to 15 A/dm$^2$, a bath temperature of 50° to 70° C. and an approximate pH range of 0.5 to 1.5. As an example of a sulfamate bath, the Japan Patent Application Publication No. 58-48038 is known in the art; A bath composed of nickel sulfate of 200 to 800 g/l, nickel chloride of 5 to 20 g/l and boric acid of 30 to 60 g/l in which sodium hypophosphite of 0.05 to 20 g/l or sodium phosphite of 0.05 to 20 g/l is included as a phosphorus-supplying agent. A plating is carried out in the bath at a cathode current density of 10 to 100 A/dm$^2$, a temperature of 50° to 70° C. and an approximate pH range of 5 to 55.

A coating weight of the electrolytic nickel phosphorus plating should be in the same range as stated for the electroless plating method. The same method as stated in electroless plating may be employed for pretreatment.

Plating on one or both sides

A nickel plating is carried out on both sides of a steel sheet and strip but a nickel phosphorus plating is done on one side or both sides depending on its use. For example, for a dry cell case of an alkaline-manganese battery or a nickel cadmium battery, only the inner side of the case is nickel plated and the outer side is nickel phosphorus plated on a nickel plated layer in order to minimize scratching during processing. However, both a nickel phosphorus plating and a nickel plating is done and carried on both sides for stationary (such as binders) and metallic tableware use.

Heat Treatment

A heat treatment is carried out after a nickel phosphorus alloy plating on a nickel plated layer. One object of the heat treatment is to provide a ductile, non-porous and adhesive coating layer owing to a formation of nickel ferrous alloy layer between a base steel and a nickel plated layer. Another object is to provide a surface hardening effect of nickel phosphorus plating by a precipitation of $Ni_3P$. Anti-scratch resistance as well as corrosion resistance is thus remarkably improved by the heat treatment.

A heat treatment is carried out in a non-oxidizing gas atmosphere at a temperature of 450° to 800° C. for a soaking time of 0.2 to 900 minutes. For a cut sheet, a heat treatment is preferably carried out in a box, annealing at a temperature of 450° to 650° for 60 to 900 minutes. A heat treatment for a steel strip may be carried out by means of a continuous annealing process as well, in which a steel strip is heated at a temperature of 600° to 800° C. for a soaking time of 0.2 to 5 minutes. Various converted gases of endothermic or exothermic gases are employed as the non-oxidizing gas. Besides these gases, hydrogen or inert gases such as helium, neon, argon or vacuum also may be used.

A nickel ferrous alloy layer is formed by a metallurgical diffusion reaction during the heat treatment. The later thickness of the alloy varies with the temperature and period of the heat treatment. It should be in the range of 0.2 to 10 microns. A thickness of less than 0.2 micron does not provide the desired improvement in adhesive bonding of the nickel plated layer to the base steel, whereas a thickness exceeding 10 microns tends to impair corrosion resistance. The reason is that the excessive diffusion of ferrous into the nickel plated layer results in red rust appearing much sooner. In order to obtain an alloy layer thickness in the range of 0.2 to 10 microns, it is essential that a steel sheet and strip be heat-treated at a temperature of 450° to 800° C. for a soaking time of 0.2 to 900 minutes as stated above. In the case of a heat treatment being carried out at a temperature of less than 450° C., the desired thickness of a nickel ferrous alloy layer cannot be formed even if a heating period is prolonged to more than 900 minutes. Whereas a temperature exceeding 800° C. tends to coarsen the grain structure of a base steel which causes deterioration of its mechanical properties. In the case of a heat treatment being carried out for a soaking time of less than 0.2 minutes, the desired thickness cannot be obtained even if a temperature is raised to more than 800° C. The above methods of nickel plating and heat treatment by which the object of the present invention is achieved have been described above. Furthermore, in order to provide a surface finish as required and to improve mechanical properties such as the prevention of a break or a stretcher strain, a steel strip may be subjected to a temper rolling with an elongation of approximate 0.5 to 5% after the heat treatment.

Effect of the Invention

According to the present invention, a nickel plated sheet and strip having an improved anti-scratch property can be provided by a heat treatment after a nickel phosphorus alloy plating on a nickel plating. The heat treatment enables a nickel plated layer to form a nickel ferrous alloy layer with a thickness of 0.2 to 10 microns under the conditions provided in the present invention. Furthermore the formation of a nickel ferrous alloy layer has an effect on the improvement of adhesion between a base steel and a nickel plated layer, which causes further improvement in formability due to the increased ductility.

The thickness of a nickel ferrous alloy layer changes according to the thickness of a nickel plated layer and a heat treatment conditions. For example, in cases where a steel sheet and strip with 2 microns thickness of nickel plating is heat-treated at 450° C. for 60 minutes, the thickness of a nickel ferrous alloy will reach 0.2 micron and the original nickel plated layer will change into the double layer consisting of a nickel ferrous alloy and a recrytallized softened nickel. On the other hand, when it is heat-treated at 750° C. for 360 minutes, the thickness will reach approximately 6 microns and the original nickel plated layer changes into an all nickel ferrous alloy layer. In either case, corrosion resistance and formability can be remarkably improved. However, a nickel plated layer becomes softened because nickel recrystallizes during a heat treatment. As a result, the anti-scratch property appears to deteriorate remarkably. In some cases, not only a surface appearance but also corrosion resistance deteriorates; far from being improved. In fact, it has been found that the surface hardness shows 155 to 180 in Vickers Hardness Number on the surface of a recrystallized nickel plated sheet, as against 285 to 300 on a surface as plated. Thus the surface of a nickel plated layer is susceptible to being scratched after a heat treatment.

To avoid these disadvantages, the present invention provides a method by which a nickel phosphorus alloy plating is carried out on a nickel plated layer, and then followed by a heat treatment to concurrently form both a nickel ferrous alloy on a base steel and a hardened nickel phosphorus alloy layer. Besides a nickel phosphorus plating method, there are many kinds of techniques relating to surface hardening, such as a gas carburizing, nitriding, a nickel boron alloy plating and a composite plating containing boron carbides. But it is considered that these methods are impractical as judged by their complexity and expense.

The advantages of the present invention are summarized as follows:

1. A nickel phosphorus alloy plating is hardened remarkably by a heat treatment in the range of which a nickel ferrous alloy layer is formed concurrently between a base steel and a nickel plated layer.

2. Phosphorus in the nickel phosphorus alloy plated layer does not diffuse into the nickel plated layer, also ferrous in a base steel does not diffuse up to the nickel phosphorus plated layer under the condition of a heat treatment in the present invention. This has the advantage that the improvement objectives are achieved at the same time by a one time heat treatment.

The present invention ill now be explained in detail referring to the examples below showing preferred embodiments (Examples 1–7) and comparative examples (Examples 8–12). These examples are for illustrative purposes only and are not to be viewed as limiting the invention to the specific examples. Other examples will be obvious to those skilled in the art.

EXAMPLE 1

A nickel plating was carried out after alkaline electrolytic degreasing and pickling by sulfuric acid on an annealed low-carbon aluminum killed steel strip of 0.25 mm thickness.

| | | |
|---|---|---|
| Bath composition: | nickel sulfate | 350 g/l |
| | nickel chloride | 45 g/l |
| | boric acid | 30 g/l |
| | sodium lauryl sulfate | 0.5 g/l |
| Bath temperature | | 50° C. |
| pH | | 4.2 |
| Current density | | 10 A/dm$^2$ |
| Coating weight of nickel | | 8.0 g/m$^2$ |

Following the nickel plating above, an electrolytic nickel phosphorus alloy plating was carried out under the following conditions:

| | | |
|---|---|---|
| Bath composition: | nickel sulfate | 150 g/l |
| | nickel chloride | 80 g/l |
| | phosphorus acid | 40 g/l |
| | phosphoric acid | 50 g/l |
| Bath temperature | | 70° C. |
| pH | | 0.6 |
| Current density | | 3 A/dm$^2$ |

The coating weight of the alloy plating was 1.4 g/m$^2$ by weight of nickel, and the phosphorus content was 15% by weight. The steel strip was water-rinsed and dried after the alloy plating. The allow plating was carried out on one side. This was the same for the other preferred embodiments and comparative examples.

Then, the heat treatment at a temperature of 520° C. for a soaking time of 360 minutes was carried out in the gas atmosphere containing 6% hydrogen and 94% nitrogen with a dew point of minus 10° C., and followed by a temper rolling with an elongation of 1.2%.

EXAMPLES 2

A nickel plating on the steel strip as in Example 1 was carried out under the same condition as in Example 1.The measurement of the coating weight showed 43.0 g/m$^2$ by weight of nickel. Then, an electrolytic nickel phosphorus alloy plating was treated under the following conditions:

| | | |
|---|---|---|
| Bath composition: | nickel sulfate | 150 g/l |
| | nickel chloride | 40 g/l |
| | phosphorous acid | 5 g/l |
| Bath temperature | | 65° C. |
| pH | | 1.3 |
| Current density | | 15 A/dm$^2$ |

The coating weight of the alloy plating was 10.8 g/m$^2$ by weight of nickel and the phosphorus content showed 3% by weight. The steel strip was water-rinsed and dried after the alloy plating and followed by the heat treatment and the temper rolling for the same conditions as shown in Example 1.

EXAMPLE 3

After degreasing and pickling, a nickel plating was carried out on a non-annealed steel strip of 0.25 mm thickness manufactured by a non-aging extra-low-carbon aluminum killed steel. The coating weight showed 18.0 g/m$^2$ by weight of nickel.

| | | |
|---|---|---|
| Bath composition: | nickel sulfamate | 400 g/l |
| | nickel chloride | 20 g/l |
| | boric acid | 30 g/l |
| | sodium lauryl sulfate | 0.5 g/l |
| Bath temperature | | 50° C. |
| pH | | 4.0 |
| Current density | | 15 A/dm$^2$ |

An electrolytic nickel phosphorus alloy plating was followed directly after the nickel plated strip was rinsed.

| | | |
|---|---|---|
| Bath composition: | nickel sulfamate | 350 g/l |
| | nickel chloride | 20 g/l |

-continued

| | | |
|---|---|---|
| | boric acid | 25 g/l |
| | phosphorous acid | 40 g/l |
| Bath temperature | | 45° C. |
| pH | | 1.2 |
| Current density | | 3 A/dm$^2$ |

The coating weight of the alloy plating showed 5.3 g/m$^2$ by weight of nickel and the phosphorus content was 8% by weight. After water-rinsing and drying, a heat treatment was carried out at a temperature of 750° C. for a soaking time of one minute, and followed by a temper rolling with an elongation of 1.5%.

EXAMPLE 4

A nickel plating and a successive nickel phosphorus alloy plating were carried on the same steel strip and under the same conditions as described in Example 3. In this case, the coating weight of the nickel plating and the alloy plating showed 27.1 g/m$^2$ and 3.5 g/m$^2$ by weight of nickel, respectively, and the phosphorus content in the alloy plating was 8% by weight. After water-rinsing and drying, the steel strip was heat-treated and temper-rolled under the same conditions as described in Example 3.

EXAMPLE 5

A nickel plating was carried on the same steel sheet and under the same conditions as described in Example 1 after electrolytic alkaline degreasing and sulfuric acid immersion. The coating weight of the nickel plating showed 17.5 g/m$^2$ by weight of nickel, then an electroless nickel phosphorus alloy plating was carried out under the following condition.

| | | |
|---|---|---|
| Bath composition: | nickel sulfate | 25 g/l |
| | sodium hypophosphite | 30 g/l |
| | malic acid | 30 g/l |
| | sodium succinate | 5 g/l |
| | lead nitrate | 1.2 mg/l |
| Bath temperature | | 90° C. |
| pH | | 4.5 |

The coating weight and content of the alloy plating showed 5.8 g/m$^2$ by weight of nickel and 11% by weight respectively. After water-rinsing and drying, the steel sheet was heat treated at a temperature of 650° C. for a soaking time of 480 minutes.

EXAMPLE 6

A steel strip was treated under the same conditions extending from nickel plating to temper rolling as described in Example 5. In this case, the coating weight of the nickel plating and the alloy plating showed 34.5 g/m$^2$ and 15.8 g/m$^2$ by weight of nickel, respectively, and the phosphorus content in the alloy plating was 11% by weight.

EXAMPLE 7

Both a nickel plating and a nickel phosphorus alloy plating were carried out on a bright annealed SUS 304 austenite stainless steel strip of 0.20 mm thickness, under the same condition as described in Example 1 after electrolytic alkaline degreasing, electrolytic pickling by sulfuric acid, and Wood's nickel strike. In this case, the coating weight of the nickel plating and the alloy plating showed 12.8 g/m$^2$ and 4.6 g/m$^2$ by weight of nickel respectively, and the phosphorus content in the alloy plating was 15% by weight. The strip was water-rinsed and dried after the alloy plating, then a heat treatment was carried out at a temperature of 780° C. for a soaking time of one minute in the same gas atmosphere as stated in Example 1, then followed by a temper rolling with an elongation of 1.5%.

EXAMPLE 8

[Comparative Example 1 ]

A nickel plating with a coating weight of 9.6 g/m$^2$ by weight of nickel was carried out on the same steel strip and under the same condition as stated in Example 1. In this case, after nickel plating, neither the nickel phosphorus plating nor the heat treatment were carried out.

EXAMPLE 9

[Comparative Example 2 ]A nickel plating with a coating weight of 9.5 g/m$^2$ by weight of nickel was carried out on the same steel strip and under the same condition as stated in Example 1. After water-rinsing and drying, the strip was heat treated at a temperature of 500° C. for a soaking time of 120 minutes in the same atmosphere as stated in Example 1, then followed by a temper rolling with an elongation of 1.2%.

EXAMPLE 10

[Comparative Example 3 ]

A nickel plating with a coating weight of 25.2 g/m$^2$ by weight of nickel was carried out on the same steel strip and under the same conditions as stated in Example 8 [Comparative Example 1]. Then, the strip was heat treated at a temperature of 550° C. for a soaking time of 600 minutes.

EXAMPLE 11

[Comparative Example 4]

A nickel plating with a coating weight of 36.7 g/m$^2$ by weight of nickel was carried out on the same steel strip and under the same conditions as stated in Example 8 [Comparative Example 1]. Then, the strip was heat treated at a temperature of 650° C. for a soaking time of 480 minutes.

EXAMPLE 12

[Comparative Example 5]

A nickel plating with a coating weight of 18.5 g/m$^2$ by weight of nickel was carried out on the same stainless steel strip as in stated in example 7 under the same conditions as stated in example 1. In this case, the strip was in a nickel plated state, with neither a nickel phosphorus alloy plating nor a heat treatment being applied.

[Test Method]

The following test methods were employed to examine the properties of the steel sheets processed according to the examples and Comparative Examples.

(1) Hardness measurement:

Hardness was measured by Vickers Hardness Tester by 5 grams.

(2) Anti-scratch resistance:

In order to estimate anti-scratch property, the surface of test specimens was scratched by a sapphire stylus with a constant load by means of Scratch Strength Tester (HEIDON-14S/D made by Shinto Kagaku Co., Ltd. in Japan), by the method of which the scratched degree could be observed and be measured by a load to begin scratching on the surface.

(3) Salt Spray Test:

Test specimens were subjected to the salt spray test according to JIS Z2371, and the appearance of red rust was estimated after a testing period of 4 hours, based on a ten-point evaluation method [10 point (good) - 1 point (poor)] on a flat part and by a grade expression [very good, good, poor and very poor] on a stretched part by the Erichsen Tester.

The test results as well as the conditions of plating and heat treatment stated in the examples [and Comparative Examples] are summarized in Table 1. The thickness of nickel ferrous alloy layer after a heat treatment was measured by a means of a Glow Discharge Emission Analysis Instrument. The results are summarized as follows:

Hardness;

In the Comparative Examples, surface hardness showed 155 to 180 Hv(5 g) after a heat treatment, as against 285 and 300 Hv(5 g) in a as-plated stte. On the other hand, it is apparent that the surface of sheets processed as in the Preferred Embodiments of Examples 1–7 is remarkably hardened to such a extent that it reaches the value of from 305 to 710 Hv(5 g).

Anti-scratch resistance;

The surface layer of sheets processed according to the present invention was damaged at the load of not less than 3 grams, as against a load of only one gram in the Comparative Examples. Thus the anti-scratch property as well as surface hardening is much improved in material treated according to the invention.

Corrosion resistance based on Salt Spray Test;

As is evident from Table 1, the corrosion resistance of a steel sheet processed as in the preferred embodiments of examples 1–7 is superior to that processed in Examples 8–12 [Comparative Examples 1–5] on both the flat part and the Erichsen stretched part.

The reason is that the nickel phosphorus alloy plated layer itself has superior corrosion resistance and the pores formed in the nickel plated layer tend to close themselves.

TABLE 1

| | | kind of base steel | Ni plate Ni ($g/m^2$) | Ni—P plate by Ni ($g/m^2$) | Ni—P plate P (weight %) | heating treatment temperature (°C.) | heating treatment soaking time (min.) | Ni—Fe alloy layer thickness (μm) | Hardness of plated surface Hv (5 g) | evaluation of scratch resistance (g) | salt spray test flat part | salt spray test stretched part |
|---|---|---|---|---|---|---|---|---|---|---|---|---|
| Preferred Embodiments (Examples 1–7) | 1. | low-carbon Al-killed steel | 8.0 | 1.4 | 15 | 520 | 360 | 1.1 | 305 | 3 | 8 | good |
| | 2. | low carbon Al-killed steel | 43.0 | 10.8 | 3 | 520 | 360 | 1.6 | 640 | 5 | 10 | very good |
| | 3. | Extra-low-carbon Al-killed steel | 18.0 | 5.3 | 8 | 750 | 1 | 1.8 | 490 | 4 | 9 | good~very good |
| | 4. | Extra-low-carbon Al-killed steel | 27.1 | 3.5 | 8 | 750 | 1 | 2.2 | 440 | 3 | 9 | very good |
| | 5. | low-carbon Al-killed | 17.5 | 5.8 | 11 | 650 | 480 | 7.5 | 515 | 4 | 9 | good~very good |
| | 6. | steel | 34.5 | 15.8 | 11 | 650 | 480 | 7.5 | 710 | 5 | 10 | very good |
| | 7. | stainless steel (SUS304) | 12.8 | 4.6 | 15 | 780 | 1 | 1.8 | 480 | 4 | 10 | very good |
| Comparative Examples (Examples 8–12) | 1. | low-carbon Al-killed steel | 9.6 | — | — | — | — | 0 | 285 | 2 | 5 | very poor |
| | 2. | low-carbon Al-killed steel | 9.5 | — | — | 500 | 120 | 0.2 | 155 | 1 | 6 | poor |
| | 3. | low-carbon Al-killed steel | 25.2 | — | — | 550 | 600 | 1.5 | 175 | 1 | 8 | good |
| | 4. | low-carbon Al-killed steel | 36.7 | — | — | 650 | 480 | 8.6 | 180 | 1 | 8 | good |
| | 5. | stainless steel (SUS304) | 18.5 | — | — | — | — | 0 | 300 | 2 | 10 | very good |

What is claimed:

1. An anti-scratch, corrosion resistant nickel plated steel sheet or strip comprising a base steel having a first layer of a nickel ferrous alloy with a coating weight of 5 to 45 $g/m^2$ by weight of nickel on each side of said sheet or strip, and further comprising a second layer of a nickel phosphorus alloy plating with a coating weight of 1 to 18 $g/m^2$ by weight of nickel and a phosphorus content of 3 to 15% by weight on at least one side of said nickel plated steel sheet and strip.

2. An anti-scratch nickel plated steel sheet or strip comprising a base steel having a first layer of a nickel ferrous alloy and a second layer of nickel plate wherein both layers have a total coating weight of 5 to 45 $g/m^2$ by weight of nickel on each side of said sheet or strip, and further comprising a third layer of a nickel phosphorus alloy plating with a coating weight of 1 to 18 $g/m^2$ by weight of nickel and a phosphorus content of 3 to 15% by weight on at least one side of said nickel plated sheet or strip.

3. The composition of claim 1 or 2, wherein the thickness of nickel ferrous alloy layer is in range of 0.2 to 10 microns.

4. The composition of claim 1 or 2 where the nickel ferrous layer is 18–36 g/m$^2$ by weight of nickel.

5. The composition of claim 1 or 2 where the nickel phosphorous alloy layer is 1–18 g/m$^2$ by weight of nickel.

6. The composition of claim 2 wherein the nickel ferrous and nickel plated layer are 18–36 g/m$^2$ by weight of nickel.

7. The composition of claim 1 or 2 wherein the nickel phosphorous coating has 5–12% phosphorous by weight.

8. A method for manufacturing an anti-scratch, corrosion resistant nickel plated steel sheet or strip comprising subjecting a base steel sheet or strip to a nickel plating having a coating weight of 5 to 45 g/m$^2$ on each side of said sheet or strip, subsequently subjecting said coated base steel or strip to a nickel phosphorus alloy plating with a coating of 1 to 18 g/m$^2$ by weight of nickel and a phosphorus content of 3 to 15% by weight on at least one side of said sheet or strip, and applying a heat treatment for a time of 0.2 to 900 minutes at a temperature of 450° to 800° C. to said sheet or strip.

9. The method of claim 8, comprising plating the nickel phosphorus alloy by an electrolytic plating method.

* * * * *

UNITED STATES PATENT AND TRADEMARK OFFICE

CERTIFICATE OF CORRECTION

PATENT NO. : 4,908,280

DATED : March 13, 1990

INVENTOR(S) : Hitoshi Omura, et al.

It is certified that error appears in the above-identified patent and that said Letters Patent is hereby corrected as shown below:

Col. 9, line 58: change "stte" to -- state --.

Signed and Sealed this

Twenty-second Day of October, 1991

*Attest:*

HARRY F. MANBECK, JR.

*Attesting Officer*

*Commissioner of Patents and Trademarks*